US007544930B2

(12) United States Patent
Yoshinari et al.

(10) Patent No.: US 7,544,930 B2
(45) Date of Patent: Jun. 9, 2009

(54) TANDEM TYPE MASS ANALYSIS SYSTEM AND METHOD

(75) Inventors: Kiyomi Yoshinari, Hitachi (JP); Yasushi Terui, Tsuchiura (JP); Toshiyuki Yokosuka, Hitachinaka (JP); Kinya Kobayashi, Hitachi (JP); Atsumu Hirabayashi, Kodaira (JP)

(73) Assignee: Hitachi High-Technologies Corporation, Tokyo (JP)

( * ) Notice: Subject to any disclaimer, the term of this patent is extended or adjusted under 35 U.S.C. 154(b) by 325 days.

(21) Appl. No.: 11/624,248

(22) Filed: Jan. 18, 2007

(65) Prior Publication Data

US 2007/0187588 A1 Aug. 16, 2007

(30) Foreign Application Priority Data

Feb. 15, 2006 (JP) ..... 2006-038461

(51) Int. Cl.
*H01J 49/00* (2006.01)

(52) U.S. Cl. ..... 250/282; 250/281; 250/283; 422/68.1; 702/22; 702/23; 702/27

(58) Field of Classification Search ..... 250/281, 250/282, 283, 288; 422/68.1
See application file for complete search history.

(56) References Cited

U.S. PATENT DOCUMENTS 5,072,115 A * 12/1991 Zhou ..... 250/281
6,017,693 A * 1/2000 Yates et al. ..... 435/5
7,158,893 B2 * 1/2007 Yoshinari et al. ..... 702/23
7,197,402 B2 * 3/2007 Mistrik ..... 702/27
2002/0063206 A1 * 5/2002 Bateman et al. ..... 250/281
2003/0028932 A1 * 2/2003 Skilling ..... 930/10
2003/0236636 A1 * 12/2003 Yoshinari et al. ..... 702/27
2006/0169889 A1 * 8/2006 Yokosuka et al. ..... 250/288
2007/0145261 A1 * 6/2007 Bern ..... 250/282

FOREIGN PATENT DOCUMENTS

JP 2001-249114 9/2001
JP 2001-330599 11/2001

* cited by examiner

*Primary Examiner*—David A Vanore
*Assistant Examiner*—Michael J Logie
(74) *Attorney, Agent, or Firm*—Antonelli, Terry, Stout & Kraus, LLP.

(57) ABSTRACT

The present invention provides a tandem type mass analysis system capable of carrying out the differential analysis with high efficiency by the tandem type mass analysis. A predetermined number of m/z regions are set up for carrying out the mass analysis with the all ions included therein being dissociated collectively for each m/z region so as to obtain measurement $MS^2$ data. By comparing the measurement $MS^2$ data with reference $MS^2$ data stored in a reference data base, a difference thereof is detected. For the m/z region with a differential component detected, the mass analysis is carried out collectively without dissociation for the all ions included therein so as to obtain measurement $MS^1$ data. By comparing the measurement $MS^1$ data with the reference $MS^1$ data, a difference thereof is detected. From the difference thereof, a parent ion considered to be the differential component factor is presumed for carrying out the mass analysis with the same being dissociated.

20 Claims, 18 Drawing Sheets

FIG. 18 A

REAL TIME EXTRACTION OF A DIFFERENTIAL COMPONENT IN THE MULTI PRECURSOR $MS^2$ DATA TO BE CARRIED OUT?

Yes ◉

No ○

FIG. 18 B

PLEASE SELECT THE REFERENCE DATA BASE.

☐ DATA BASE A

☑ DATA BASE B

☐ ...

FIG. 18 C

SPECIFICATION OF THE MULTI PRECURSOR $MS^2$

•PLEASE SELECT THE NUMBER OF MASS CHARGE RATIO REGION DIVISION, AND THE DIVIDING METHOD.

[15] NUMBER OF DIVISION [A] DIVIDING METHOD

SPECIFICATION OF THE DETAILED TANDEM ANALYSIS $MS^n$ AT THE TIME OF DETECTING THE DIFFERENTIAL COMPONENT.

•PLEASE SELECT THE ANALYSIS EVENT AT THE TIME OF THE DETAILED TANDEM ANALYSIS.

[$MS^1 \Rightarrow MS^2 \Rightarrow MS^3 \Rightarrow MS^2 \Rightarrow MS^3$]

TANDEM TYPE MASS ANALYSIS SYSTEM AND METHOD

BACKGROUND OF THE INVENTION

1. Field of the Invention

The present invention relates to a tandem type mass analysis system, and in particular, it relates to the differential analysis using a tandem type mass analysis system.

2. Description of the Related Art

The outline of the differential analysis using the tandem type mass analysis will be explained with reference to FIG. 1. According to the tandem type mass analysis, first, the mass analysis distribution of the substances contained in a specimen is measured. Thereby, the mass analysis spectra ($MS^1$) of the first stage can be obtained. The horizontal axis of the mass analysis spectra denotes the ratio of the mass to the charge m/z, and the vertical axis the number of detected ions. Next, from the mass analysis spectra of the first stage ($MS^1$), the ions are selected from the one having a higher number of detected ions. Here, the ions A, B, D are selected. The ions selected accordingly are referred to as precursor ions or parent ions. The parent ions are dissociated, and each of the dissociated ions is measured for the mass analysis distribution. Thereby, the mass analysis spectra of the second stage ($MS^2$) can be obtained.

The mass analysis spectra ($MS^2$) of the second stage are compared with the mass analysis spectra of the second stage ($MS^2$) of standard specimens measured preliminarily. In the case there is a difference therebetween, the ion is judged to be a differential component of the specimen.

In the case comparison of the mass analysis spectra of the second stage is insufficient, the differential component may be determined by obtaining the mass analysis spectra of the third stage ($MS^3$) and comparing the same with the mass analysis spectra of the standard specimen. Accordingly, by obtaining the mass analysis spectra of the multiple stages and comparing the same with the mass analysis spectra of the standard specimen, further accurate specimen differential analysis results can be obtained.

Accordingly, the tandem type mass analysis denotes the technique of repeating selection of the parent ions and dissociation of the same for carrying out the mass analysis.

For example, the mass analysis spectra ($MS^2$) are measured preliminarily from a specimen derived from a healthy person and they are stored in a reference data base. By the comparison of the mass analysis spectra ($MS^2$) obtained from a specimen derived from an examinee with the mass analysis spectra ($MS^2$) of the healthy person, the differential component is detected. From the differential component detected accordingly, the health state of the examinee can be judged.

Japanese Patent Application Laid-Open Nos. 2001-249114 and 2001-330599 disclose an example of the differential analysis of comparing the mass analysis spectra obtained from a specimen derived from an examinee with the mass analysis spectra obtained from a specimen derived from a healthy person stored in a standard data base.

In the differential analysis using the tandem type mass analysis, for improving the detection accuracy of the differential component, a larger number of the selected parent ions is preferable. In the embodiment of FIG. 1, the ions A, B, D are selected as the parent ions without selecting the ion C. With the premise that the differential component was not detected as a result of comparison of the mass analysis spectra of the second stage mass analysis spectra of the ions A, B, D and the mass analysis spectra of the standard specimen, in this case, it is judged that the specimens as the analysis subjects do not have a differential component. However, a differential component may be detected by comparing the mass analysis spectra of the second stage of the ion C and the mass analysis spectra of the standard specimen.

If the number of the parent ions is increased, the process of measuring the mass analysis spectra of the second stage ($MS^2$) is increased. In general, most of the components in the analysis subject specimens is included in the standard specimen. Therefore, most of the measurement process for the second mass analysis spectra ($MS^2$) concerning the parent ions is wasted. With a larger number of the parent ions, the wasteful measurement process is increased accordingly.

SUMMARY OF THE INVENTION

An object of the present invention is to provide a tandem type mass analysis system capable of carrying out the differential analysis with high efficiency by the tandem type mass analysis.

A tandem mass analysis system of the present invention includes the following processes (1) to (6). The measured first stage mass analysis spectra are referred to as the measurement $MS^1$ data, and the second stage mass analysis spectra as the measurement $MS^2$ data, the measurement $MS''$ data, or the like. The corresponding mass analysis spectra of the reference specimen stored in the reference data base are each referred to as the reference $MS^1$ data, the reference $MS^2$ data, the reference $MS^3$ data, the reference $MS''$ data, or the like:

(1) Mass analysis is carried out for the reference specimens for storing the reference $MS^1$ data, the reference $MS^2$ data, or the like in a reference data base.

(2) A predetermined number of m/z regions are set up by dividing the entire region of the mass charge ratio m/z capable of being processed by the mass analysis by the tandem type mass analysis system into a plurality of regions. The mass analysis is carried out for each m/z region Ri by dissociating together the all ions included therein. Thereby, the measurement $MS^2$ data are obtained.

(3) By comparing the measurement $MS^2$ data with the reference $MS^2$ data stored in the reference data base, the difference thereof, that is, whether or not a differential component is present is detected.

(4) Mass analysis is carried out for the m/z regions with the differential components detected without dissociating together the all ions included therein. Thereby, the measurement $MS^1$ data are obtained.

(5) The measurement $MS^1$ data are compared with the reference $MS^1$ data for detecting the difference thereof. From the difference, the parent ion considered to be the differential component factor detected in (3) is presumed. With the presumed parent ion being dissociated, the mass analysis is carried out. Thereby, the measurement $MS^2$ data are obtained for each parent ion. By comparing the measurement $MS^2$ data with the reference $MS^2$ data, the difference thereof, that is, whether or not a differential component is present is detected. Such a mass analysis is repeated for the necessary number of stages.

(6) From the multiple stage measurement $MS''$ data, the substance of the differential component of the mass analysis subject specimen with respect to the reference specimen is identified.

According to the present invention, the differential analysis can be carried out highly efficiently by the tandem type mass analysis.

BRIEF DESCRIPTION OF THE DRAWINGS

FIG. 18 is a diagram showing an embodiment of a user interface in the tandem type mass analysis method according to the present invention.

DESCRIPTION OF THE PREFERRED EMBODIMENT

Figure 1:
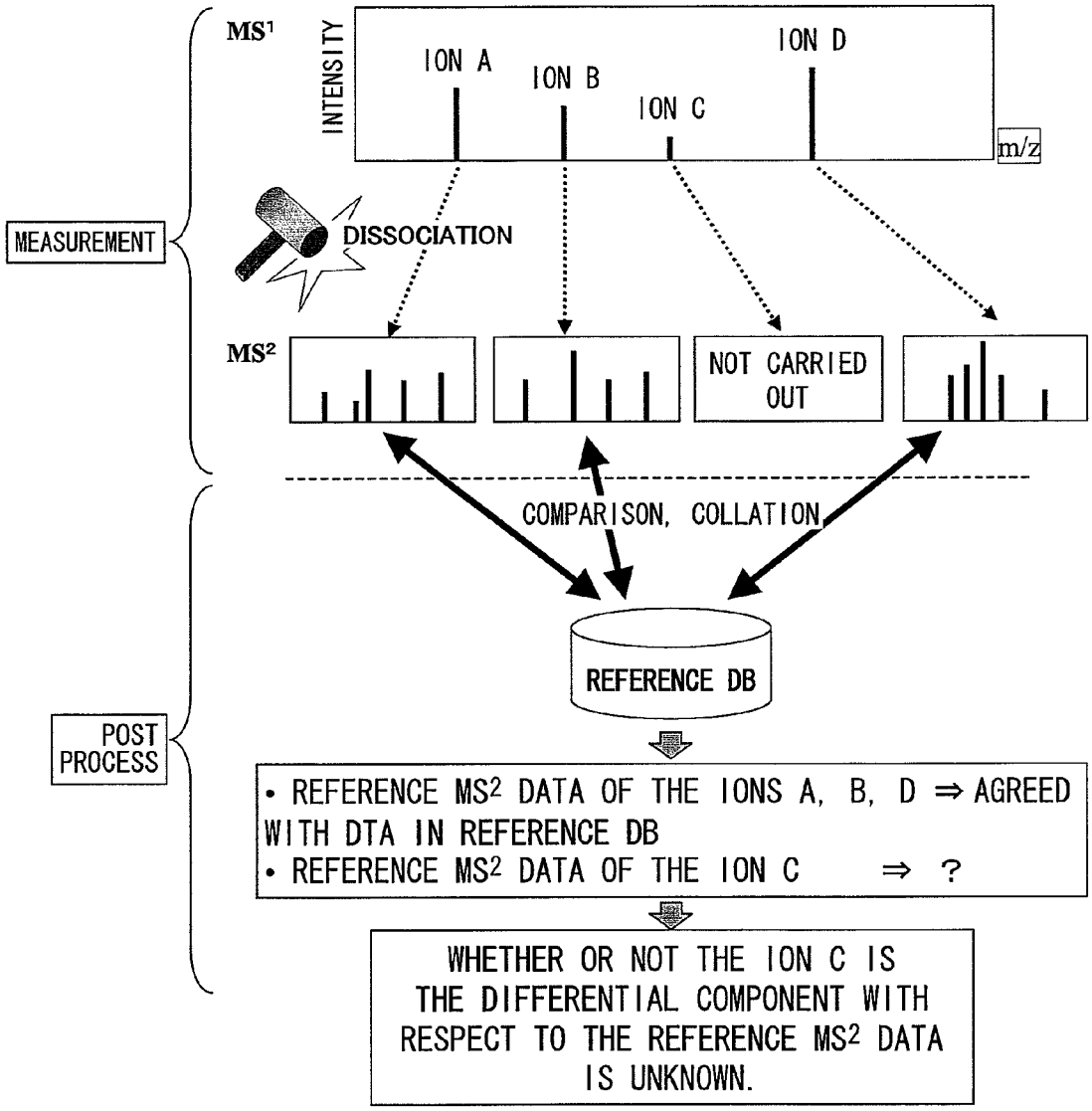
FIG. 1 is an explanatory chart for explaining the process of the conventional tandem type mass analysis method.
Figure 2:
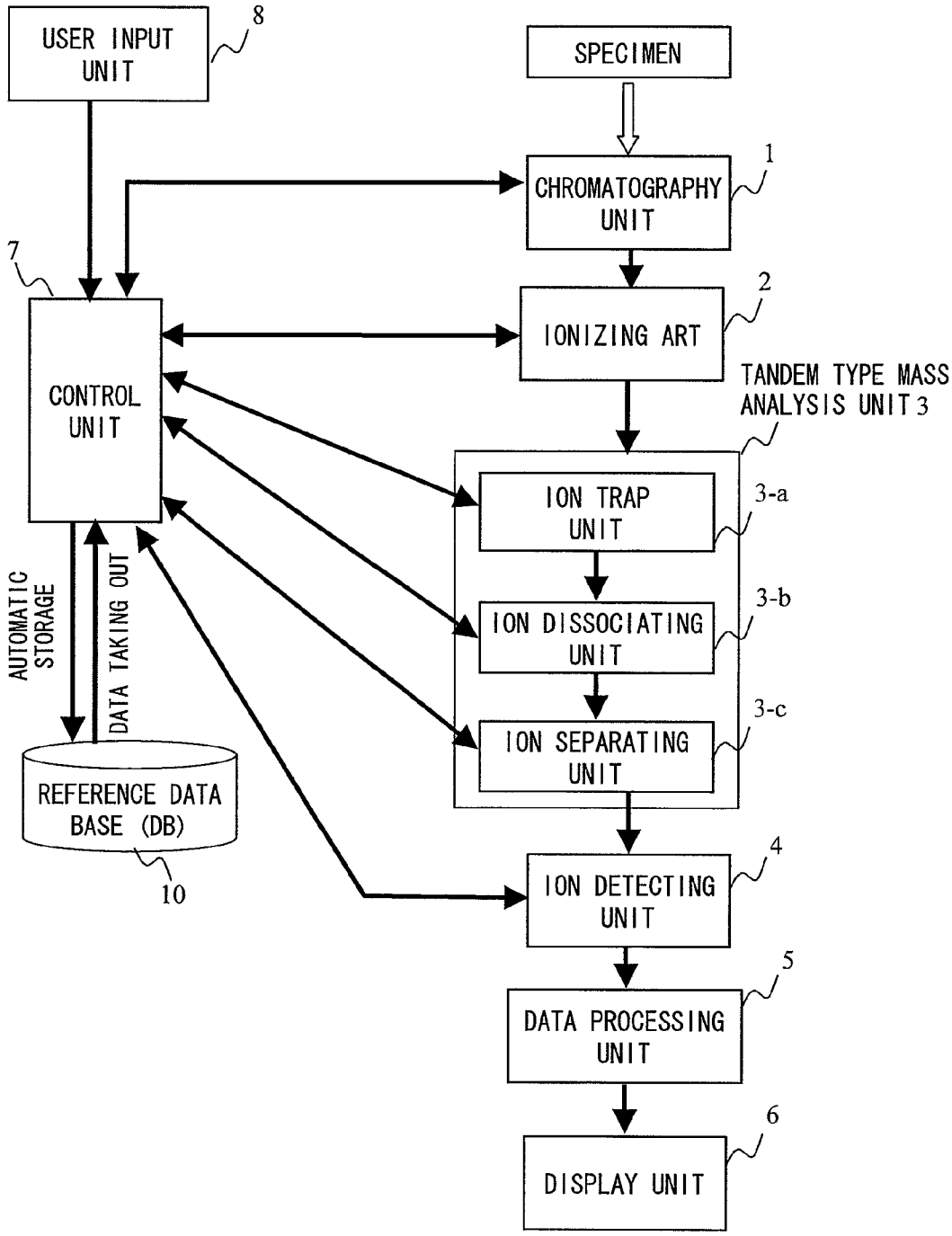
FIG. 2 is a schematic diagram for a tandem type mass analysis system according to the present invention.

With reference to FIG. 2, an embodiment of the tandem type mass analysis system according to the present invention will be explained. The tandem type mass analysis system of this embodiment has a chromatography unit 1, an ionizing unit 2, a tandem type mass analysis unit 3, an ion detecting unit 4, a data processing unit 5, a display unit 6, a control unit 7, a user input unit 8, and a reference data base 10. The tandem type mass analysis unit 3 has an ion trap unit 3-*a*, an ion dissociating unit 3-*b* and an ion separating unit 3-*c*.

The specimen of the mass analysis subject is a biopolymer based substance such as a protein and a sugar chain, or a low molecular weight substance such as a chemical. The specimen is first, introduced into the chromatography unit 1. The chromatography unit 1 comprises a liquid chromatography (LC) or a gas chromatography (GC). In the description below, the chromatography unit 1 comprises a liquid chromatography (LC).

The substances included in the specimen are separated and sectioned according to the adsorption force difference to the column of the liquid chromatography as time passes. The specimen is further ionized at the ionizing unit 2. The specimen may be ionized directly by injecting the specimen without using a chromatography.

In the tandem type mass analysis of the present invention, a parent ion with its mass charge ratio m/z being equal to a specific value or within a specific mass charge ratio m/z region is dissociated and separated.

In this embodiment, as a method of dissociating the parent ion, a collision induced dissociation method of dissociating the parent ion by having the parent ion collide with a buffer gas such as helium is used. The ion dissociating unit 3-*b* comprises a collision cell filled with neutral gas.

The ion trap unit 3-*a* captures parent ions with their mass charge ratio (m/z) being equal to a specific value or within a specific mass charge ratio (m/z) region and inputs them collectively in the collision cell. For capturing a specific parent ion, for example, a resonance voltage of a predetermined frequency is superimposed and applied on a trap voltage so as to have the ions to be excluded in a resonance stage.

The ion dissociating unit 3-*b* has a parent ion with its mass charge ratio (m/z) being equal to a specific value or within a specific mass charge ratio (m/z) region collide with neutral gas in the collision cell for dissociation. For having the parent ion collide with the neutral gas, a voltage of a frequency to be resonated with the parent ion is applied. The ion dissociated accordingly is separated per mass charge ratio m/z in the ion separating unit 3-*c*.

The parent ions may be dissociated by collision with the neutral gas in the ion trap unit 3-*a* filled with the neutral gas. In this case, the collision cell is unnecessary.

As the method for dissociating the parent ions, the electron capture dissociation method for having the parent ions capture a large amount of the low energy electrons by directing low energy electrons to the parent ions and dissociating them, the electron transfer dissociation method for irradiating the parent ions with an ion beam and dissociating by moving the electrons, or the like may be used as well.

The ion detecting unit 4 detects the number of ions dissociated for each mass charge ratio m/z and outputs mass analysis spectra. The data processing unit 5 compares the mass analysis spectra obtained by the ion detecting unit 4 with the mass analysis spectra of the standard specimen or the reference specimen stored in the reference data base 10. Details of the process in the data processing unit 5 will be explained later. The reference data base 10 stores various mass analysis spectra preliminarily measured for the standard specimen and the reference specimen. An example of the mass analysis spectra stored in the reference data base 10 will be explained later.

The measured mass analysis spectra are displayed on the display unit 6. In the case data different from the data of the mass analysis spectra stored in the reference data base 10 are obtained, the data processing unit 5 stores the same in the reference data base 10. The control unit 7 controls the series of the mass analysis process, that is, ionization of the specimen, mass analysis, selection of the parent ions, repetition of the mass analysis, and data display.

Hereafter, the first stage mass analysis spectra obtained by the ion detecting unit 4 are referred to as the measurement $MS^1$ data, the second stage mass analysis spectra as the measurement $MS^2$ data, the third stage mass analysis spectra as the measurement $MS^3$ data, and the nth stage mass analysis spectra as the measurement $MS^n$ data. The corresponding mass analysis spectra of the reference specimen stored in the reference data base are each referred to as the reference $MS^1$ data, the reference $MS^2$ data, the reference $MS^3$ data, the reference $MS^n$ data, or the like. In the case of obtaining the first stage mass analysis spectra, the mass analysis is carried out without dissociating the ions, however, in the case of obtaining the mass analysis spectra of the second stage and thereafter, the mass analysis is carried out with the ions being dissociated.

Figure 3:
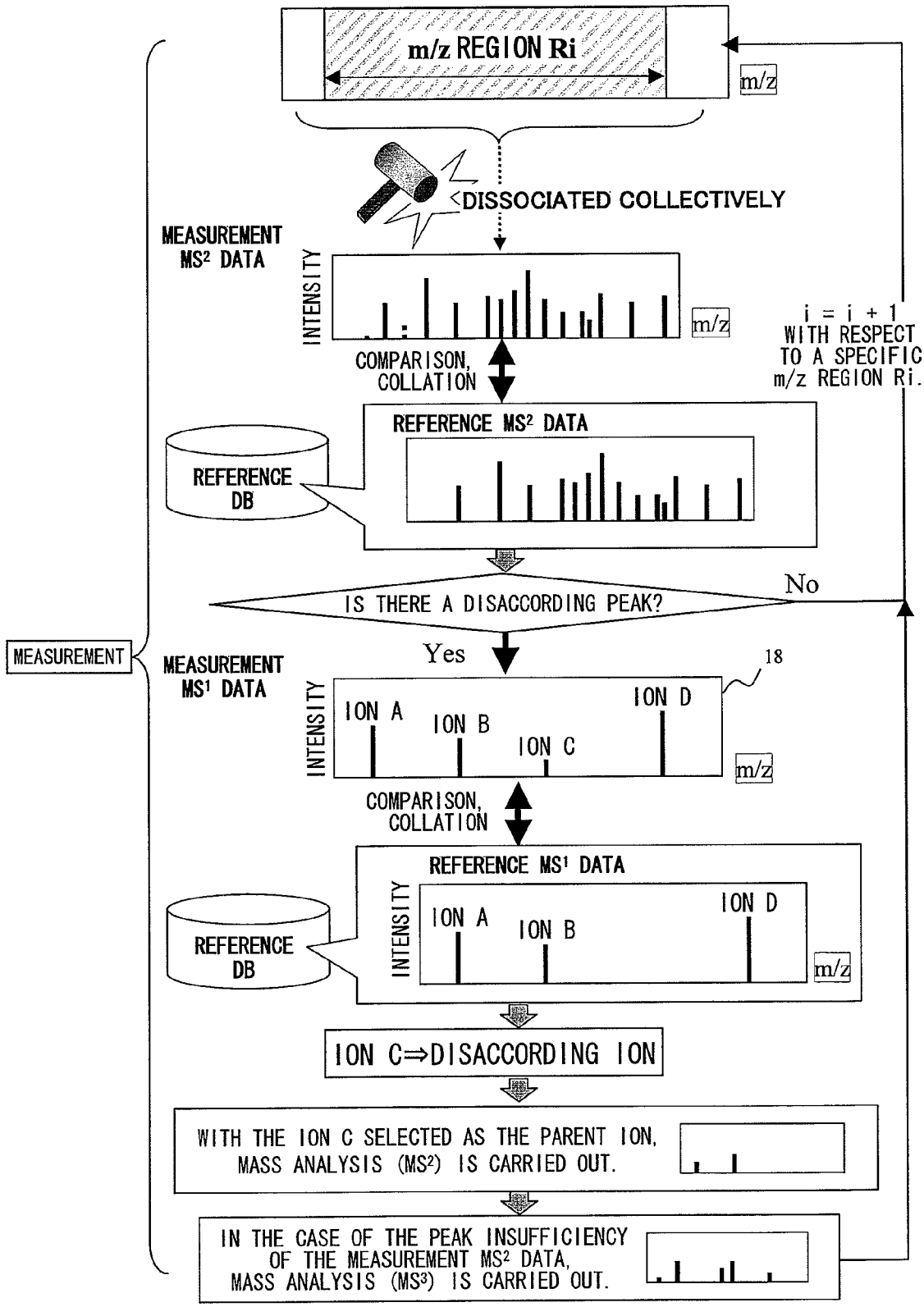
FIG. 3 is a schematic explanatory chart for explaining the tandem type mass analysis method according to the present invention.

The concept of the tandem type mass analysis method of the present invention will be explained with reference to FIG. 3. First, the entire region of the mass charge ratio m/z capable of carrying out the mass analysis by the tandem type mass analysis system is divided into a plurality of regions for setting up a plurality of mass ranges, that is, the m/z regions. An example of the m/z region Ri setting up method will be explained later with reference to FIG. 17. Next, mass analysis is carried out with the all ions included in each m/z regions being dissociated, per each m/z region Ri. Accordingly, the measurement $MS^2$ data are obtained.

By comparing the measurement $MS^2$ data with the reference $MS^2$ data stored in the reference data base, the difference thereof is detected. The difference is a difference of the peaks representing ions. In the case a difference is not detected, the measurement $MS^2$ data are measured for the following m/z region. In the case a difference is detected, the tandem type mass analysis is carried out for the all ions in the m/z region Ri. That is, mass analysis is carried out for the all ions in the m/z region for obtaining the measurement $MS^1$ data 18. By comparing the measurement $MS^1$ data with the reference $MS^1$ data in the reference data base 10, the difference thereof, that is, the differential component is detected.

It is assumed that the four ions A, B, C, D are detected in the measurement $MS^n$ data and the three ions A, B, D are included in the reference $MS^1$ data. The ion C is the differential component. Then, the ion C is selected as the parent ion. That is, it can be presumed that the ion C is the cause of the difference between the measurement $MS^1$ data and the reference $MS^1$ data. The tandem type mass analysis is carried out for the ion C. Thereby, the measurement $MS^2$ data can be obtained. The ion of the differential component is detected by comparing the measurement $MS^2$ data with the reference $MS^2$ data in the reference data base 10. Furthermore, by repeating the mass analysis, the reference $MS^n$ data may be calculated.

According to the present invention, the measurement $MS^2$ data are measured for each m/z region, and they are compared with the reference $MS^2$ data. According to the results of the comparison, the tandem type mass analysis is carried out for the m/z regions with a difference, and the mass analysis is not carried out for the regions without a difference. Therefore, the tandem type mass analysis can be carried out efficiently.

According to this embodiment, since the tandem type mass analysis process can be carried out efficiently, a sufficient time can be allotted for the analysis. Therefore, even in the case the differential component is included by only a minute amount, the chance of detecting the same can be increased.

The process in the tandem type mass analysis system of the present invention will be explained with reference to FIG. 4. In the step S11, the entire region of the mass charge ratio m/z capable of carrying out the mass analysis by the tandem type mass analysis system is divided into a plurality of regions for setting up a plurality of the m/z regions. Then, a m/z region Ri is selected.

In the step S 12, mass analysis is carried out with the all ions included in the selected m/z region R(i) being dissociated. Thereby, the measurement $MS^2$ data 13 in the all ions in the m/z region R(i) can be obtained. In the step S 14, the reference $MS^2$ data of the all ions in the same m/z region R(i) of the standard specimen stored in the reference data base are read out.

In the step S15, the measurement $MS^2$ data 13 and the reference $MS^2$ data are compared on the real time basis. In the step S 16, the difference between the measurement $MS^2$ data 13 and the reference $MS^2$ data, that is, whether or not a differential component is present is judged. In the case there is not a differential component, it returns to the step S 12 for selecting the next m/z region R (i+1). Hereafter, the steps S12 to S16 are repeated.

Figure 5:
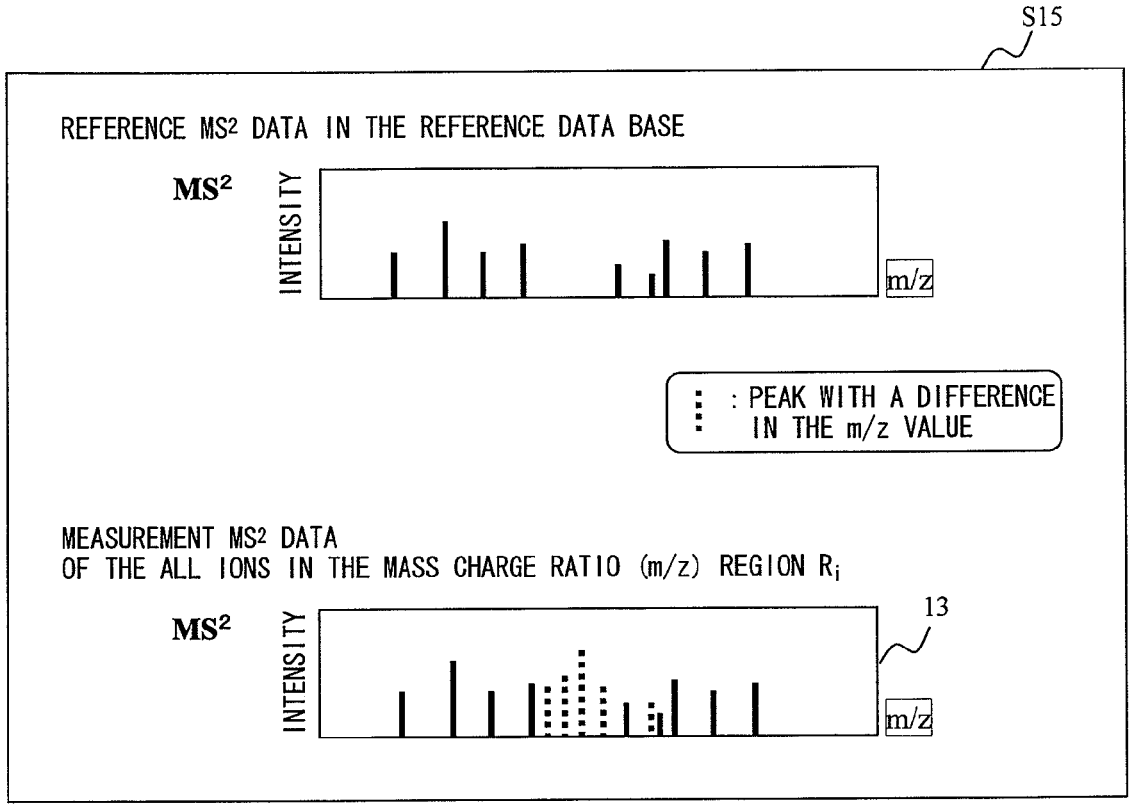
FIG. 5 is an explanatory chart for explaining a first embodiment of the process for comparing the measurement $MS^2$ data with the reference $MS^2$ data in the reference data base of the tandem type mass analysis method of the present invention.

FIG. 5 shows an embodiment of the measurement $MS^2$ data 13 and the reference $MS^2$ data. The peaks shown by the dotted lines are the differential components.

In the step S16, in the case there is a differential component, it proceeds to the step S 17. In the step S17, the mass analysis is carried out for the all ions in the m/z region R(k) with the differential components for obtaining the measurement $MS^1$ data 18. In the step S19, the measurement $MS^1$ data 18 are compared with the reference $MS^2$ data stored in the reference data base for detecting a differential component. Thereby, the ions as the cause of the differential components detected in the step S16 are presumed for selecting the same as the parent ions. It is assumed that Np pieces ($Np \geqq 1$) of the parent ions are selected. Details of the process in the step S19 will be explained later.

In the step S20, dissociation and mass analysis are carried out for Np pieces ($Np \geqq 1$) of the parent ion for obtaining the measurement $MS^2$ data. By comparing the same with the reference $MS^2$ data stored in the reference data base, the differential components are detected. Hereafter, as needed, the nth stage measurement $MS^n$ data are obtained for analyzing the differential components. In the step S21, the next m/z region R(k+1) is selected, and it returns to the step S12.

Figure 6:
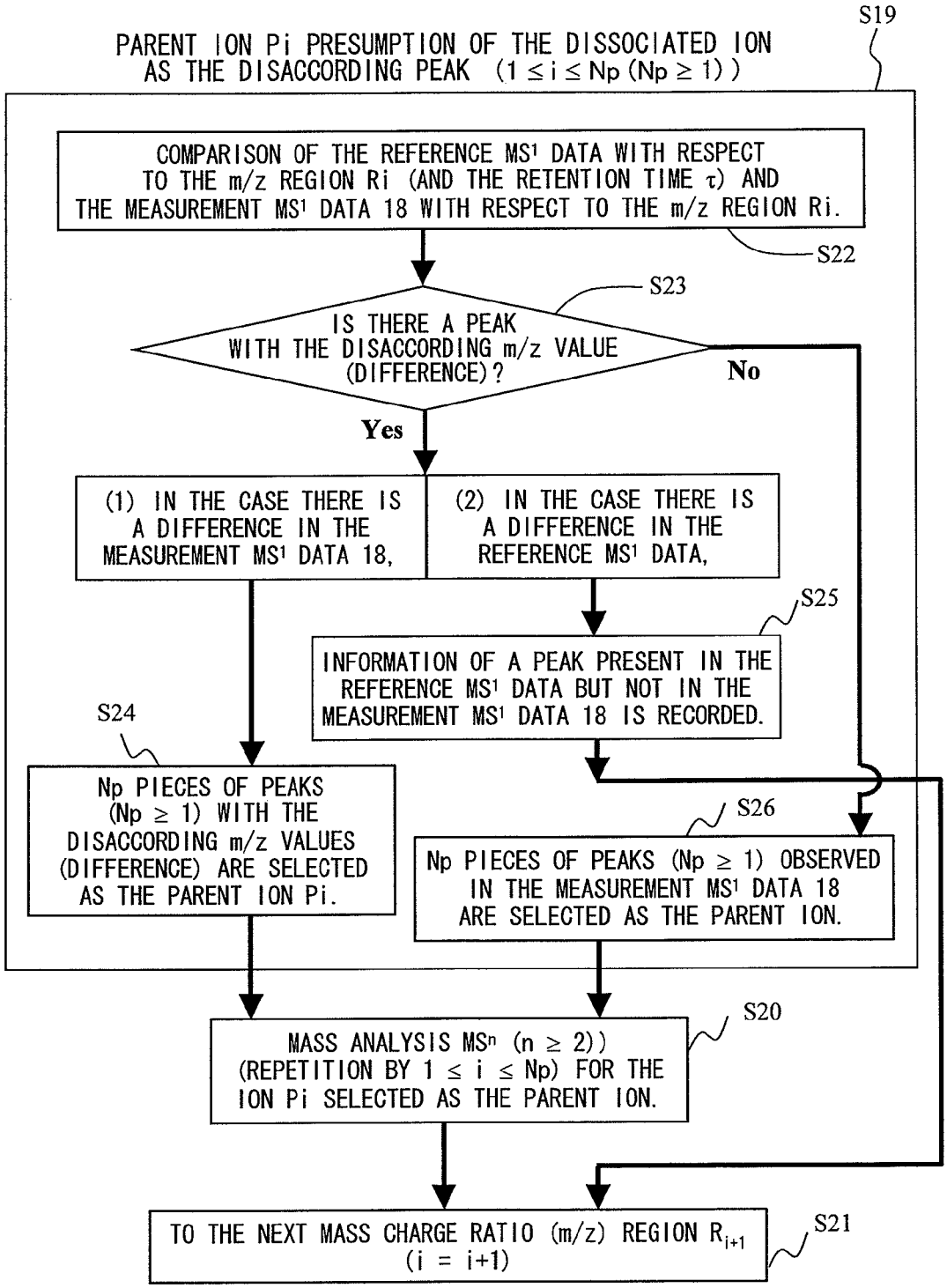
FIG. 6 is an explanatory chart for explaining a first embodiment of a presuming process for a parent ion Pi to be the cause of the disaccording peaks between the measurement $MS^2$ data and the reference $MS^2$ data in the tandem type mass analysis method according to the present invention.

With reference to FIG. 6, a first embodiment of the presuming process of the parent ion Pi to be the cause of the disaccording peaks of the measurement $MS^2$ data and the reference $MS^2$ data in the step S19 will be explained. In the step S22, the measurement $MS^1$ data 18 of the m/z region R(k) with a differential component and the reference $MS^1$ data stored in the reference data base are compared. In the step S23, whether or not there is a difference therebetween is judged. Here, whether or not there is a peak with a different m/z value is judged. In the case there is a peak with a different m/z value, it proceeds to the step S24 or the step S25.

In the case there is not a peak with a different m/z value, since the cause of the mismatch between the measurement $MS^2$ data and the reference $MS^2$ data is unknown, it proceeds to the step S26.

In the step S26, Np pieces (Np≧1) of the parent ions are selected as the parent ions out of the ions observed in the measurement $MS^1$ data 18, and it proceeds to the step S20. In the step S20, the tandem type mass analysis is carried out for the parent ions.

In the step S23, in the case it is judged that there are peaks with different m/z values, furthermore, there are (1) the case with peaks with different m/z values in the measurement $MS^1$ data 18, and (2) the case with peaks with different m/z values in the reference $MS^1$ data.

In the case of (1), it proceeds to the step S24 for selecting the peaks with the m/z values disaccording as the parent ions, and it proceeds to the step S20. Here, it is assumed that Np pieces (Np≧1) of the parent ions are selected. In the step S20, the tandem type mass analysis is carried out for the parent ions.

In the case of (2), it proceeds to the step S25 for recording the information of the peaks present in the reference $MS^1$ data but not in the measurement $MS^1$ data in the reference data base 10, and it proceeds to the step S21.

Figure 7:
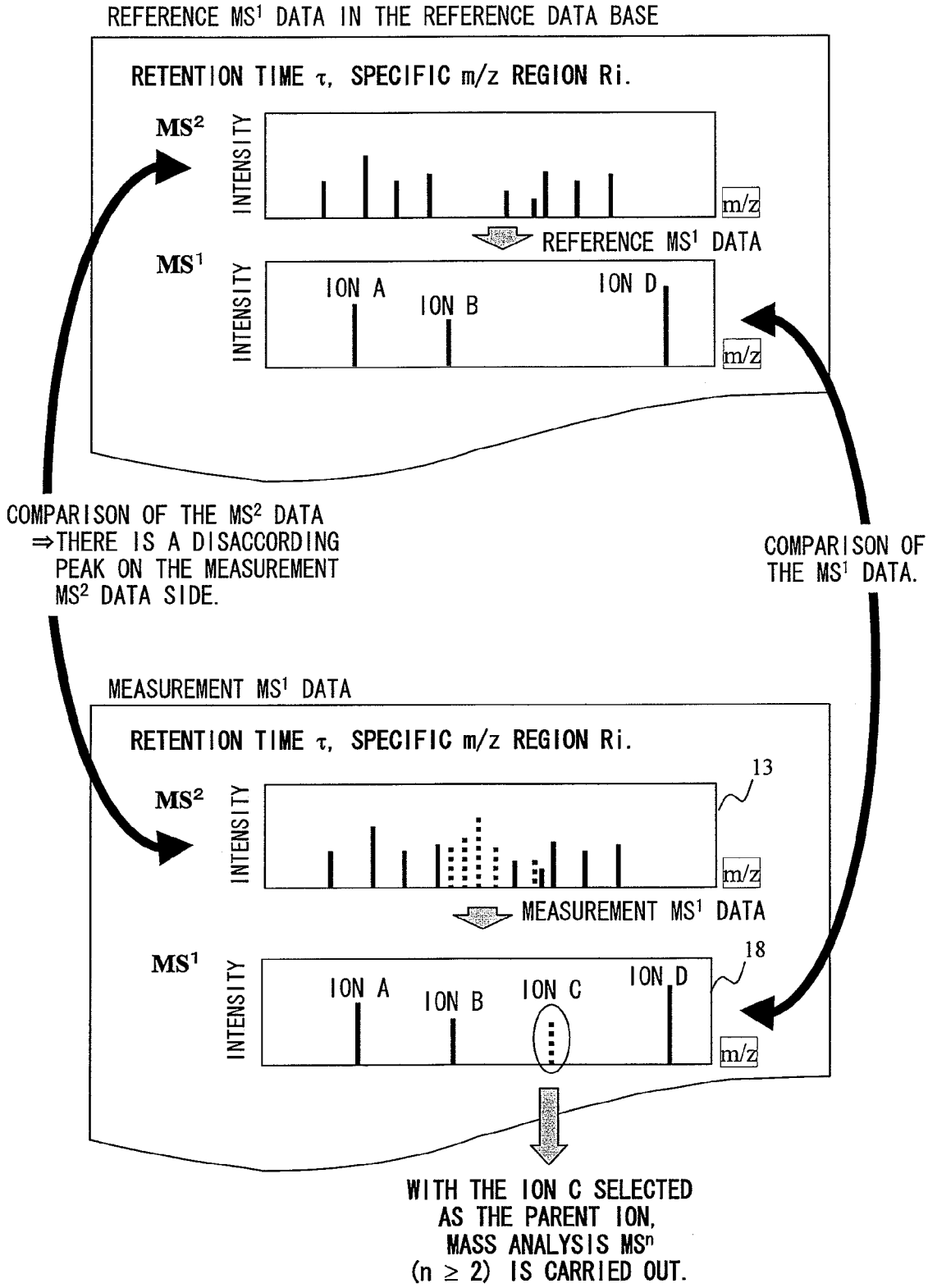
FIG. 7 is an explanatory chart for explaining the case having peaks with different m/z values in the measurement $MS^1$ data so as to have a difference between the measurement $MS^1$ data and the reference $MS^1$ data in the first embodiment of the presuming process for a parent ion Pi in the tandem type mass analysis method according to the present invention.

FIG. 7 shows the case with peaks with different m/z values in the measurement $MS^2$ data as shown by the dotted lines in the process for judging whether or not there is a difference between the measurement $MS^2$ data 13 and the reference $MS^2$ data in the step S16. Here, in the comparison between the reference $MS^1$ data and the measurement $MS^1$ data 18 in the step S22, the case (1) with peaks with different m/z values in the measurement $MS^1$ data 18 is shown. Although the ion C is observed in the measurement $MS^1$ data 18, it is not observed in the reference $MS^1$ data in the reference data base. Therefore, the ion C is selected as the parent ion in the step S26 for carrying out the mass analysis $MS^n$ (n≧2) in the step S20.

Figure 8:
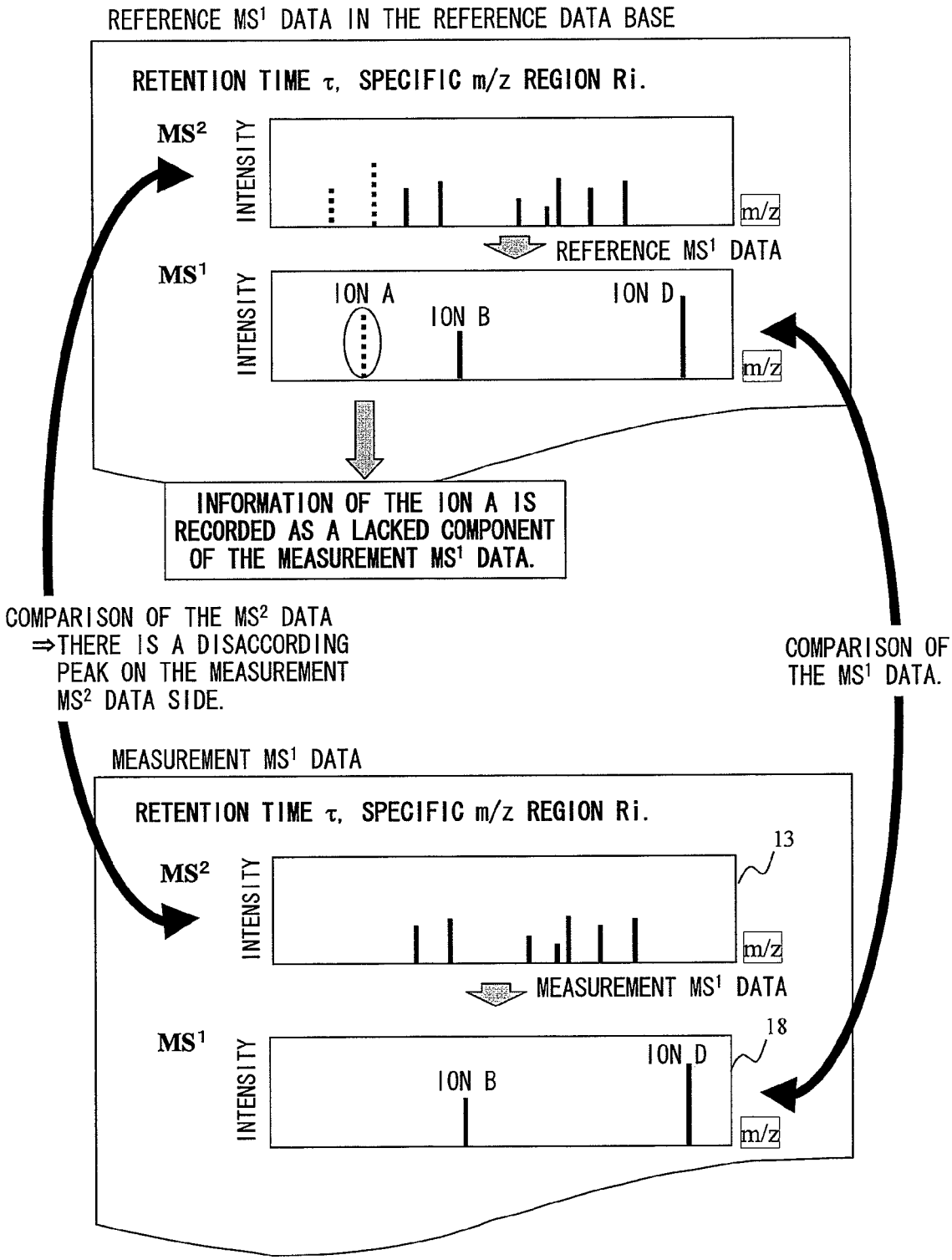
FIG. 8 is an explanatory chart for explaining the case having peaks with different m/z values in the measurement $MS^1$ data so as to have a difference between the measurement $MS^1$ data and the reference $MS^1$ data in the first embodiment of the presuming process for a parent ion Pi in the tandem type mass analysis method according to the present invention.

FIG. 8 shows the case with peaks with different m/z values in the reference $MS^2$ data as shown by the dotted lines in the process for judging whether or not there is a difference between the measurement $MS^2$ data 13 and the reference $MS^2$ data in the step S16. Here, in the comparison between the reference $MS^1$ data and the measurement $MS^1$ data 18 in the step S22, the case (2) with peaks with different m/z values in the reference $MS^1$ data in the reference data base is shown. The ion A is not observed in the measurement $MS^1$ data 18, but it is observed in the reference $MS^1$ data. Therefore, the ion A is a lacked component in the measurement $MS^1$ data 18. In the step S25, the ion A is recorded as the lacked component in the measurement $MS^1$ data 18 in the reference data base. Next, it proceeds to the step S21.

Figure 9:
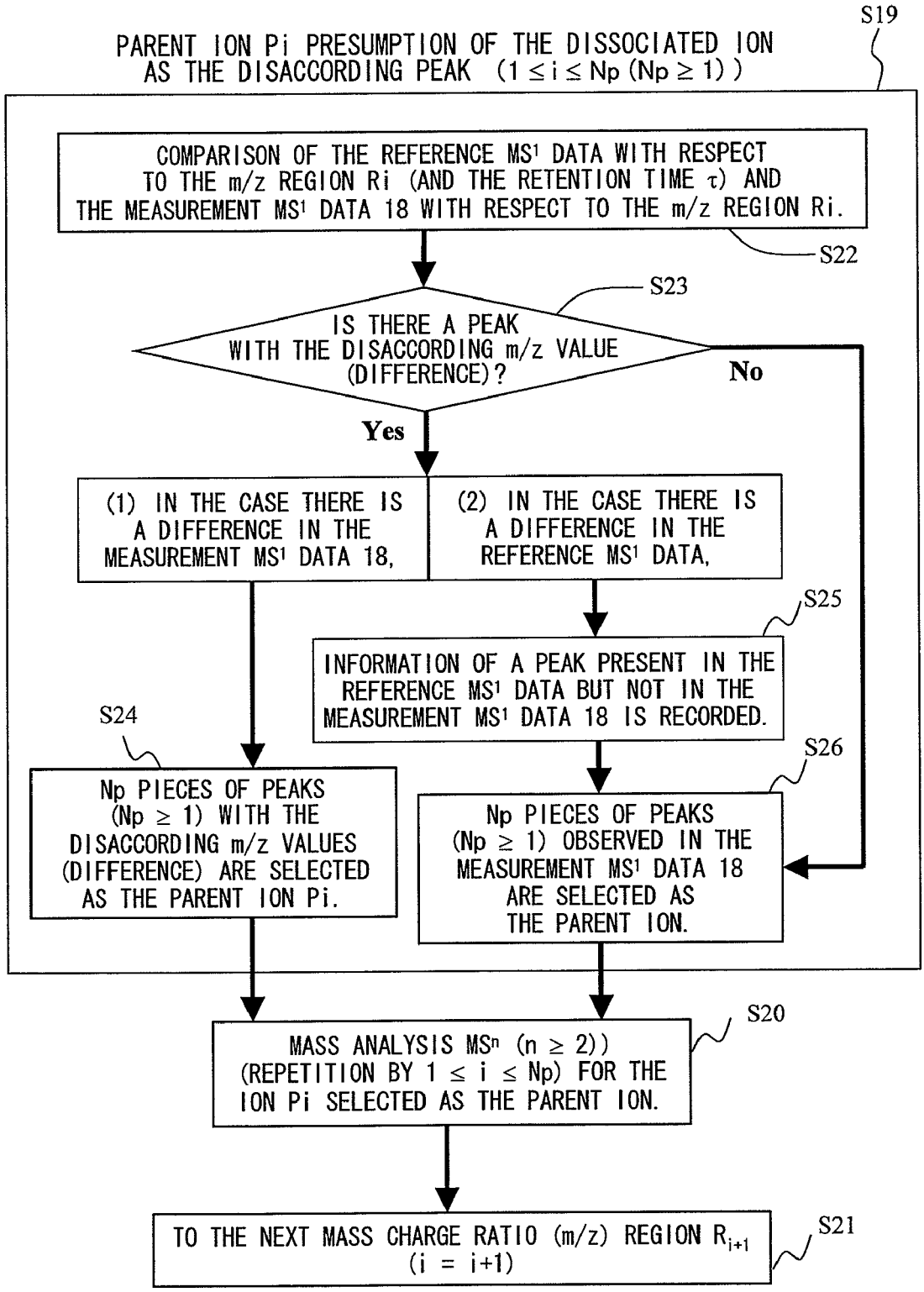
FIG. 9 is an explanatory chart for explaining a second embodiment of a presuming process for a parent ion Pi to be the cause of the unmatched peaks between the measurement $MS^2$ data and the reference $MS^2$ data in the tandem type mass analysis method according to the present invention.

With reference to FIG. 9, a second embodiment of the presuming process of the parent ion Pi to be the cause of the disaccording peaks between the measurement $MS^2$ data and the reference $MS^2$ data in the step S19 will be explained. In this embodiment, compared with the first embodiment of FIG. 6, the process in the case it is judged that there is a peak with a different m/z value in the step S23, and furthermore, (2) there is a peak with a different m/z value in the reference $MS^1$ data is different.

In the case of (2), it proceeds to the step S25 for recording the information of the peaks present in the reference $MS^1$ data but not in the measurement $MS^1$ data in the reference data base 10, and it proceeds to the step S26. In the step S26, Np pieces (Np≧1) of the parent ions are selected as the parent ions out of the ions observed in the measurement $MS^1$ data 18, and it proceeds to the step S20.

In this embodiment, as the cause of the disaccording peaks in the measurement $MS^2$ data and the reference $MS^2$ data, whether or not there is a factor in addition to the lacked component in the measurement $MS^1$ data 18 can be confirmed. Therefore, according to this embodiment, the accuracy improvement of the differential component extraction with respect to the reference data can be expected.

Figure 10:
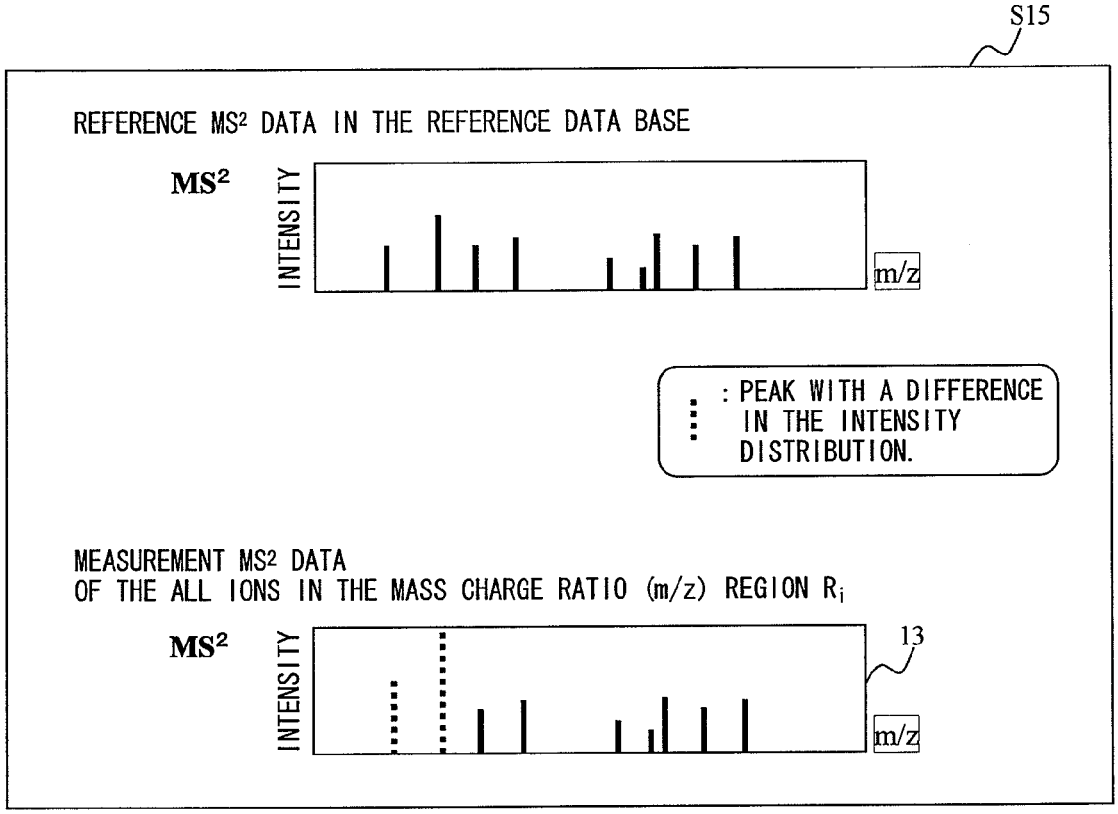
FIG. 10 is an explanatory chart for explaining a second embodiment of the process for comparing the measurement $MS^2$ data with the reference $MS^2$ data in the reference data base of the tandem type mass analysis method of the present invention.

With reference to FIG. 10, another embodiment of the method for judging the difference between the two mass analysis spectra in the step S15, that is, whether or not a disaccording peak is present will be explained. In the embodiment of FIG. 5, by comparing the two mass analysis spectra, in the case there is a peak with a different m/z value therebetween, it is judged that there is a differential component. However, in this embodiment, by comparing the two mass analysis spectra, in the case there is peaks with different intensities even where the m/z value is same therebetween, it is judged that there is a differential component. The peaks of the dotted lines included in the measurement $MS^2$ data have different intensities even though the m/z value is same compared with the peaks of the solid lines of the reference $MS^2$ data.

Figure 4:
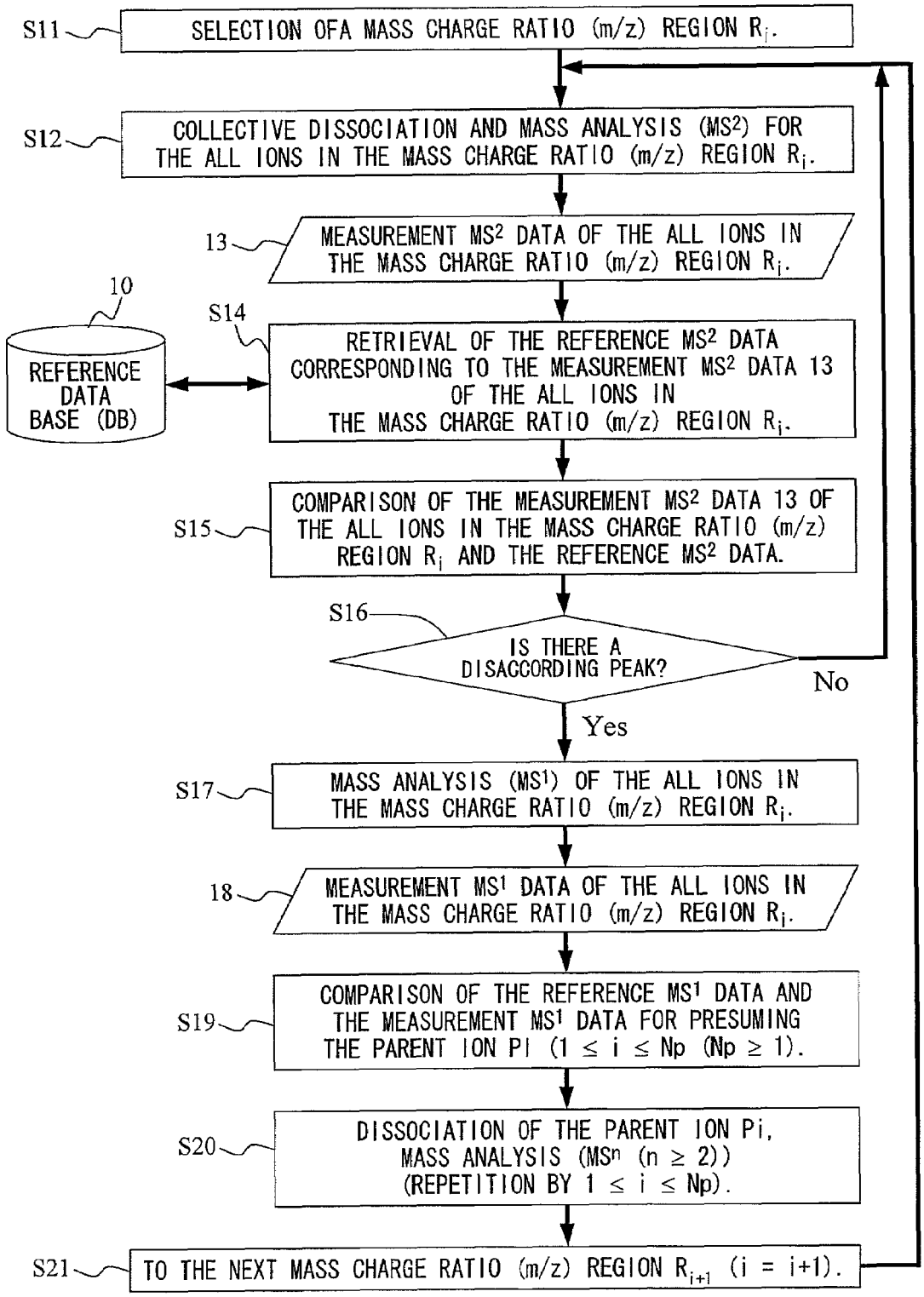
FIG. 4 is a schematic chart for explaining the process of the tandem type mass analysis method according to the present invention.

In the process for comparing the measurement $MS^2$ data 13 and the reference $MS^2$ data in the step S15 in FIG. 4, and in the process for comparing the measurement $MS^1$ data 18 and the reference $MS^1$ data in the step S22 in FIG. 6 and FIG. 9, in the case there is a peak with a different intensity even though the m/z value is same, it is judged that there is a differential component.

Figure 11:
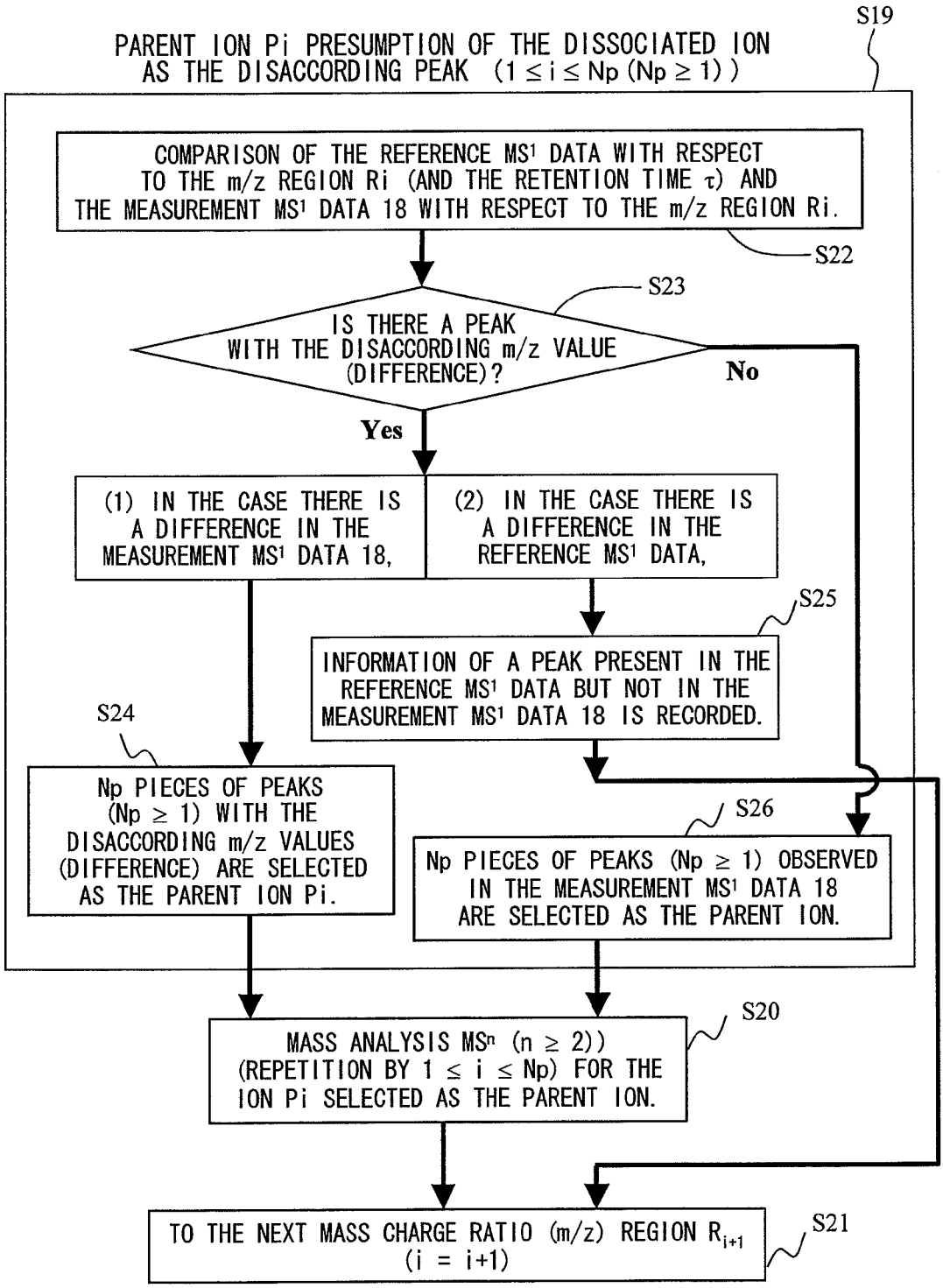
FIG. 11 is an explanatory chart for explaining a third embodiment of a presuming process for a parent ion Pi to be the cause of the unmatched peaks between the measurement $MS^2$ data and the reference $MS^2$ data in the tandem type mass analysis method according to the present invention.

With reference to FIG. 11, a third embodiment of the presuming process of the parent ion Pi to be the cause of the disaccording peaks between the measurement $MS^2$ data and the reference $MS^2$ data in the step S19 will be explained. In the step S22, the measurement $MS^1$ data 18 of the m/z region R(k) with a differential component and the reference $MS^1$ data stored in the reference data base are compared. In the step S23, whether or not there is a difference therebetween is judged. That is, whether nor not there is a peak with a different m/z value or a peak with a different intensity even with the same m/z value is judged. In the case there is a peak with a different m/z value, or a peak with a different intensity even with the same m/z value, it proceeds to the step S24 or the step S25.

In the case there is neither a peak with a different m/z value nor a peak with a different intensity with the same m/z value, since the cause of the disaccording peak of the measurement $MS^2$ data and the reference $MS^2$ data is unknown, it proceeds to the step S26. The process hereafter is same as the first embodiment shown in FIG. 6.

In this embodiment, also in the process for judging whether or not there is a difference between the measurement $MS^2$ data 13 and the reference $MS^2$ data in the step S16, whether or not there is a peak with a different m/z value or a peak with a different intensity even with the same m/z value is judged.

Figure 12:
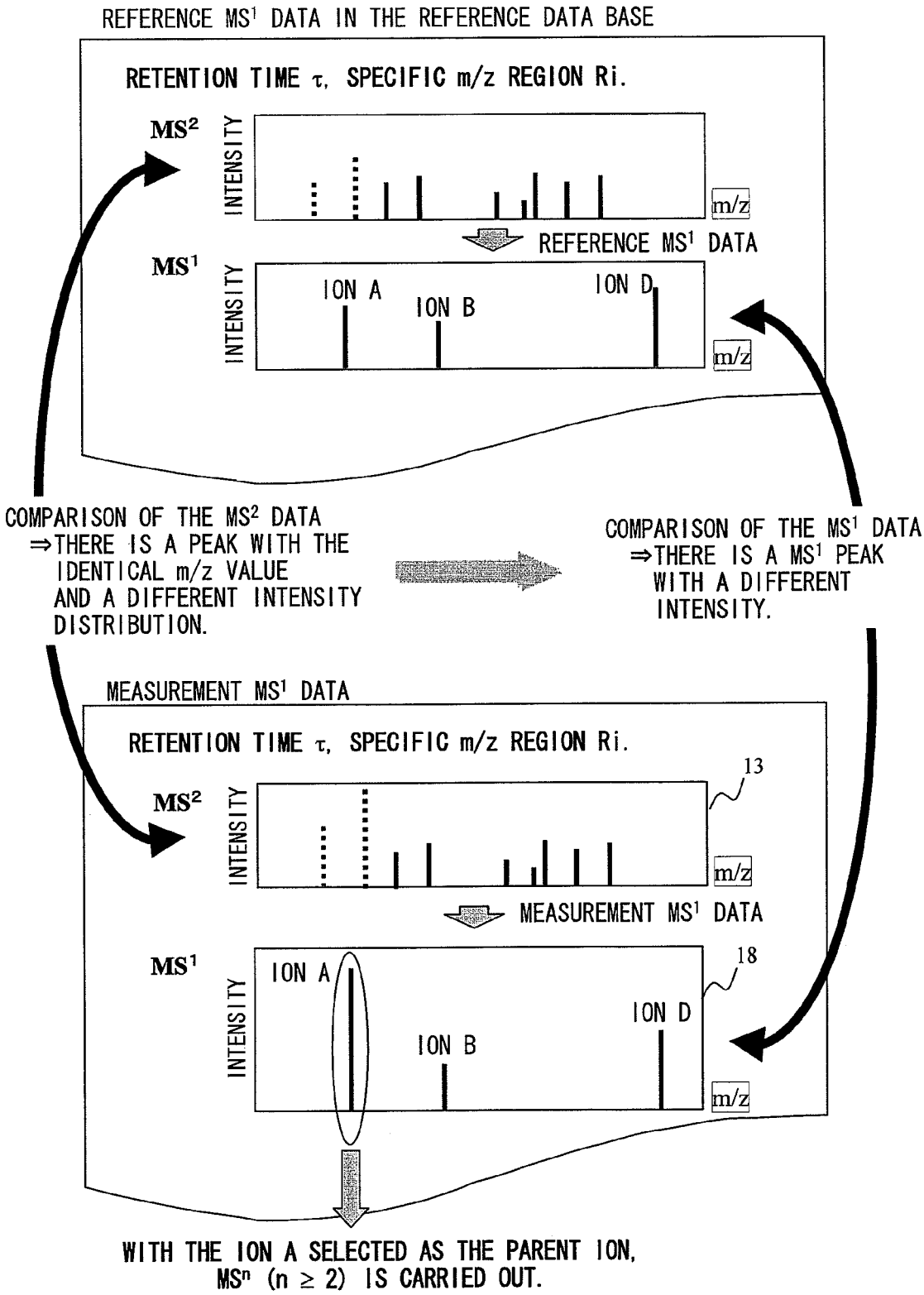
FIG. 12 is an explanatory chart for explaining the case having peaks with different m/z values in the measurement $MS^1$ data so as to have a difference between the measurement $MS^1$ data and the reference $MS^1$ data in the third embodiment of the presuming process for a parent ion Pi in the tandem type mass analysis method according to the present invention.

FIG. 12 shows the case with two peaks with different intensities although the m/z value is same as shown by the dotted lines in the process for judging whether or not there is a difference between the measurement $MS^2$ data 13 and the reference $MS^2$ data in the step S16. In this embodiment, it is judged that there is a difference therebetween, and mass analysis is carried out for the all ions in the m/z region R(k) in the step S17 for obtaining the measurement $MS^1$ data 18.

In the step S19, from the measurement $MS^1$ data 18, the ion to be the cause of the differential component detected in the step S16 is presumed. An ion having the same m/z value as the ion A in the measurement $MS^1$ data 18 is present in the reference $MS^1$ data in the reference data base. However, their intensities differ. Here, the ion A is presumed as the parent ion.

Figure 13:
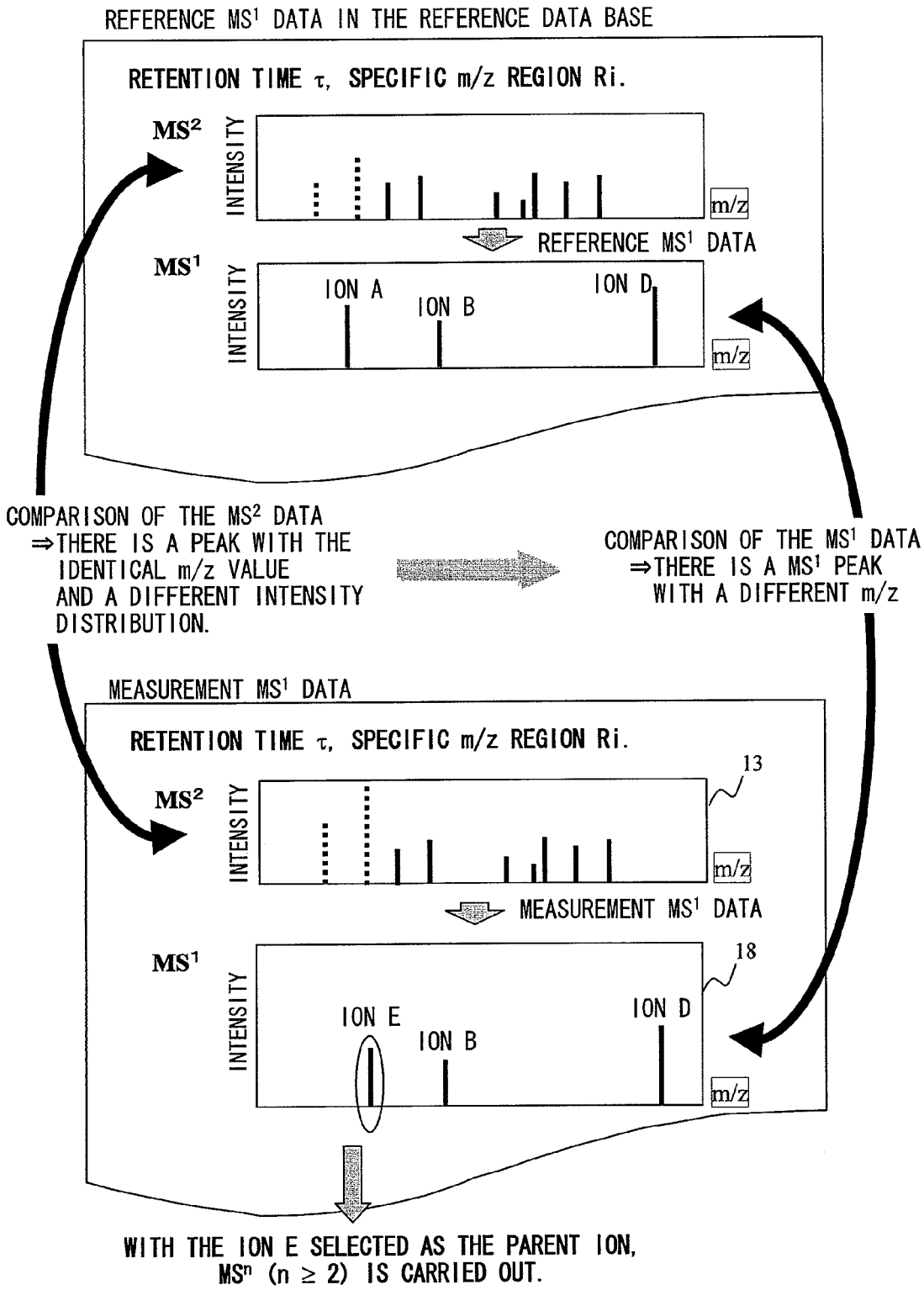
FIG. 13 is an explanatory chart for explaining the case having peaks with different m/z values in the measurement $MS^1$ data so as to have a difference between the measurement $MS^1$ data and the reference $MS^1$ data in the third embodiment of the presuming process for a parent ion Pi in the tandem type mass analysis method according to the present invention.

FIG. 13 shows the case with two peaks with different intensities although the m/z value is same as shown by the dotted lines in the process for judging whether or not there is a difference between the measurement $MS^2$ data 13 and the reference $MS^2$ data in the step S16. Therefore, it is judged that there is a difference therebetween, and mass analysis is carried out for the all ions in the m/z region R(k) in the step S17 for obtaining the measurement $MS^1$ data 18.

In the step S19, from the measurement $MS^1$ data 18, the ion to be the cause of the differential component detected in the step S16 is presumed. The ion E in the measurement $MS^1$ data 18 and the ion A in the reference $MS^1$ data in the reference data base have different m/z values and intensities. Therefore, the ion E is presumed as the parent ion.

In this embodiment, in the comparison of the reference data and the actual measurement data, in consideration of not only the difference of the m/z value of the peak but also the intensity distribution, the differential portion is detected. Therefore, by extracting also the differential with respect to both the amount of the substance present in the specimen and the expression amount, identification of the component can be enabled.

Figure 14:
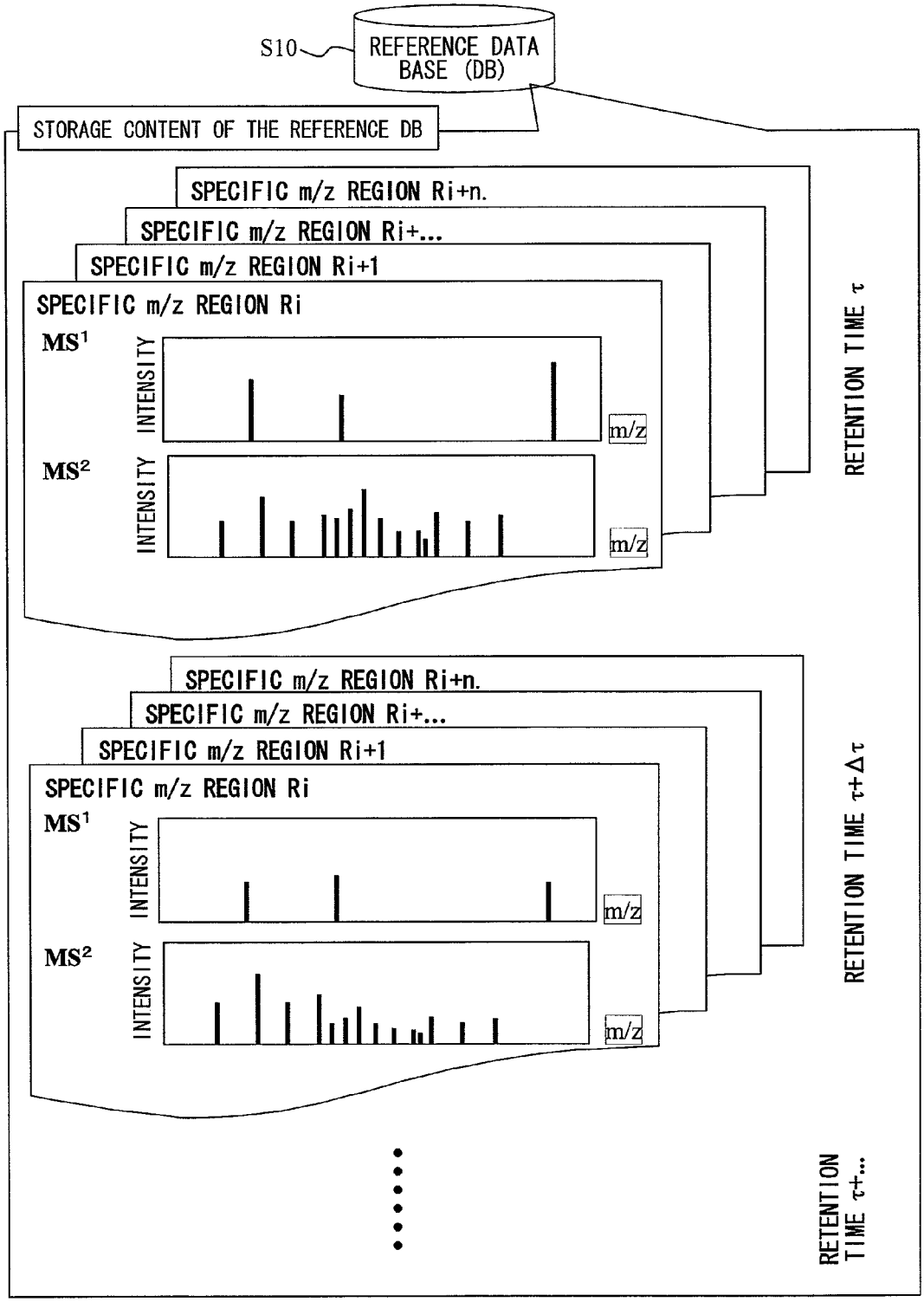
FIG. 14 is a chart showing a first embodiment of data stored in the reference data base of the tandem type mass analysis system according to the present invention.

With reference to FIG. 14, a first embodiment of the reference data base 10 provided in the tandem type mass analysis system of the present invention will be explained. In the reference data base 10, with reference to the specimen to be referred, the reference $MS^1$ data for a specific m/z region Ri, and the reference $MS^2$ data for the all ions included in each m/z region Ri are stored for each LC elution time (retention time).

Figure 15:
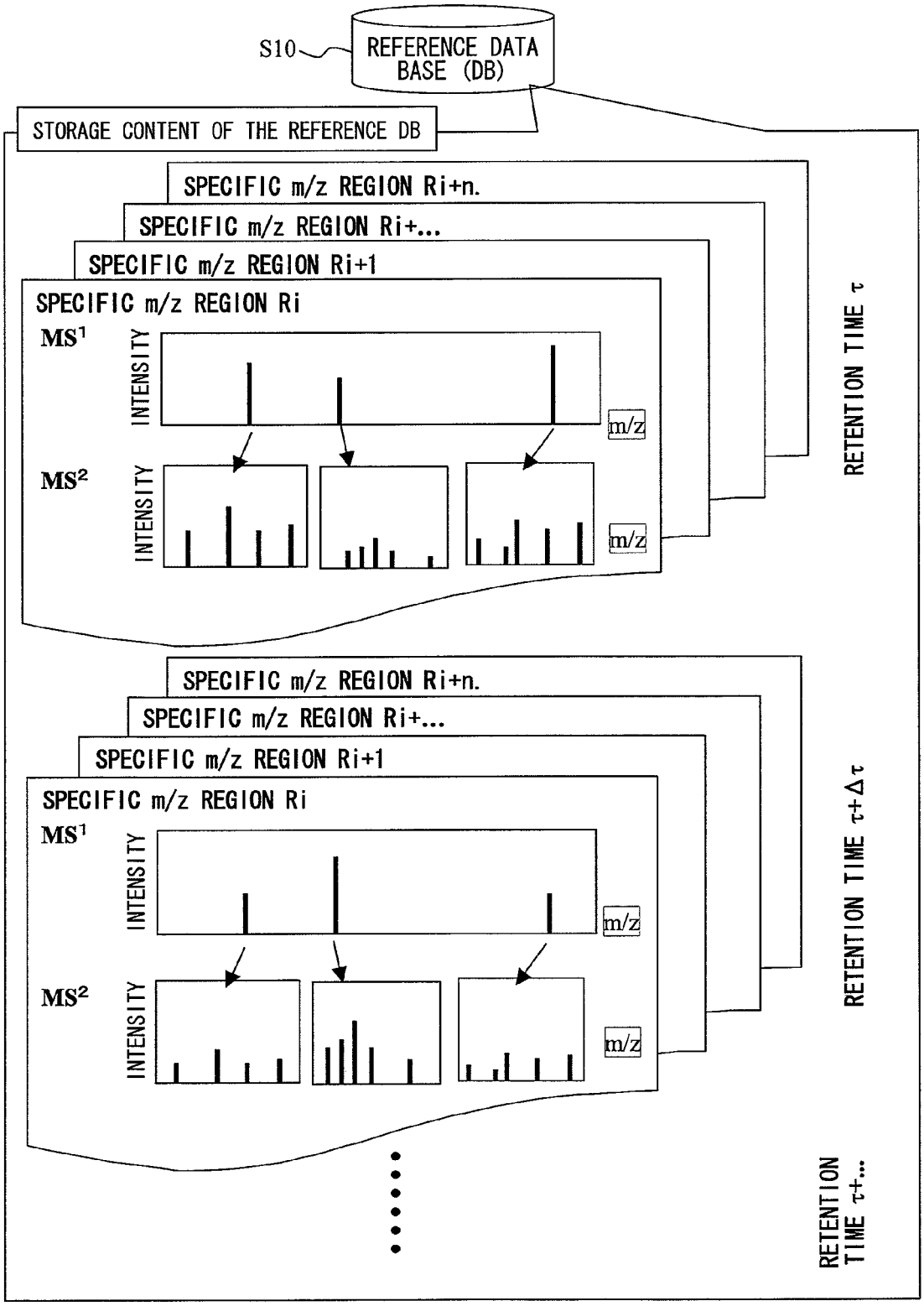
FIG. 15 is a chart showing a second embodiment of data stored in the reference data base of the tandem type mass analysis system according to the present invention.

With reference to FIG. 15, a second embodiment of the reference data base 10 provided in the tandem type mass analysis system of the present invention will be explained. In the reference data base 10, with reference to the specimen to be referred, the reference $MS^1$ data for a specific m/z region Ri, and the reference $MS^2$ data for the all ions included in each m/z region Ri per each ion are stored for each LC elution time (retention time).

Figure 16:
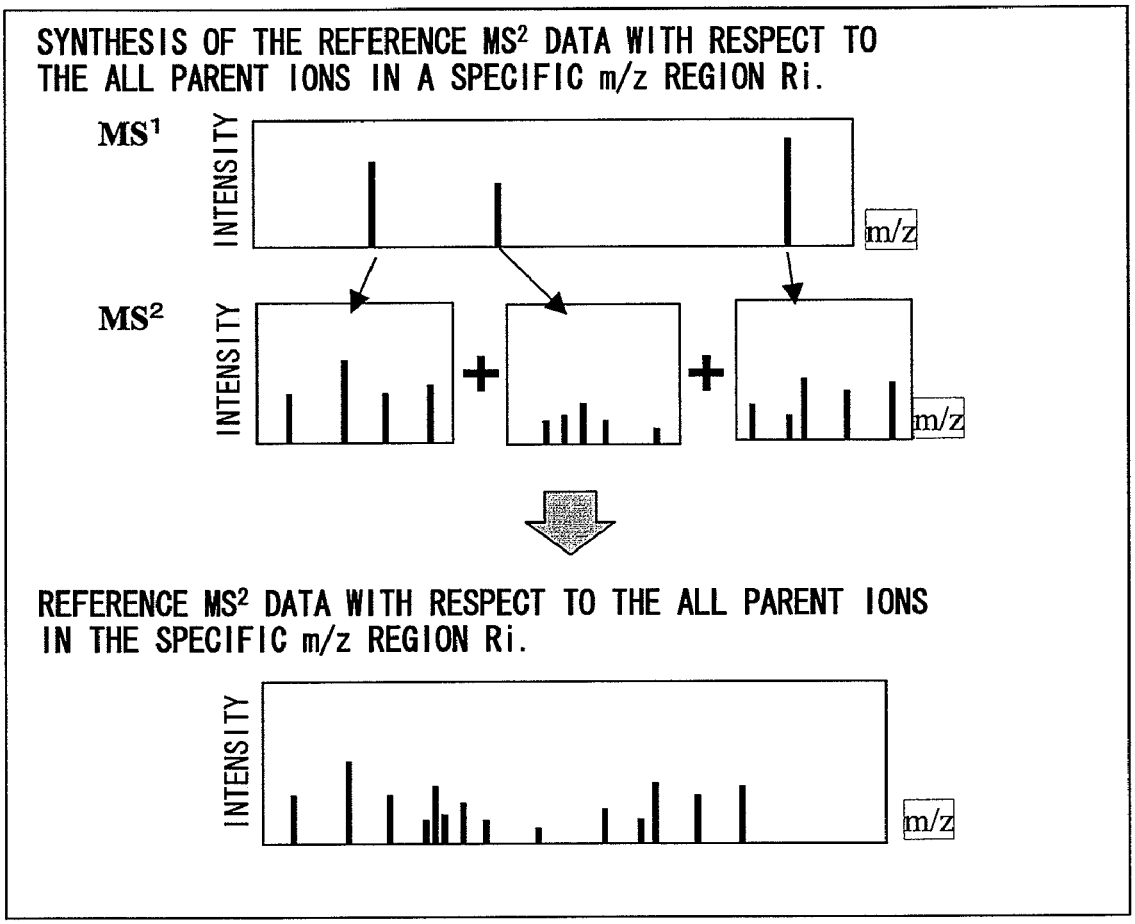
FIG. 16 is a chart for explaining the method for producing reference $MS^2$ data by synthesizing two reference $MS^2$ data in the tandem type mass analysis method according to the present invention.

FIG. 16 is for explaining the method for synthesizing the reference $MS^2$ data 13 of the reference data base 10 of FIG. 14 from the reference $MS^2$ data 13 of the reference data base 10 of FIG. 15. The reference $MS^2$ data for each ion are merged in a state with the intensity ratio of each peak maintained for each LC elution time.

Figure 17A:
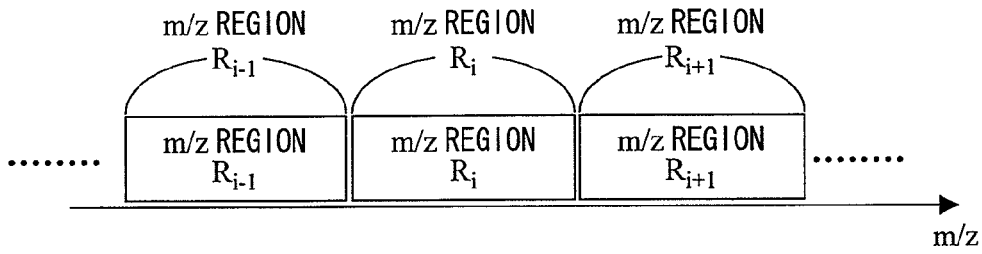
FIG. 17 is a chart for explaining the method for dividing the mass charge ratio m/z region of the specimen ions in the tandem type mass analysis method according to the present invention.
Figure 17B:
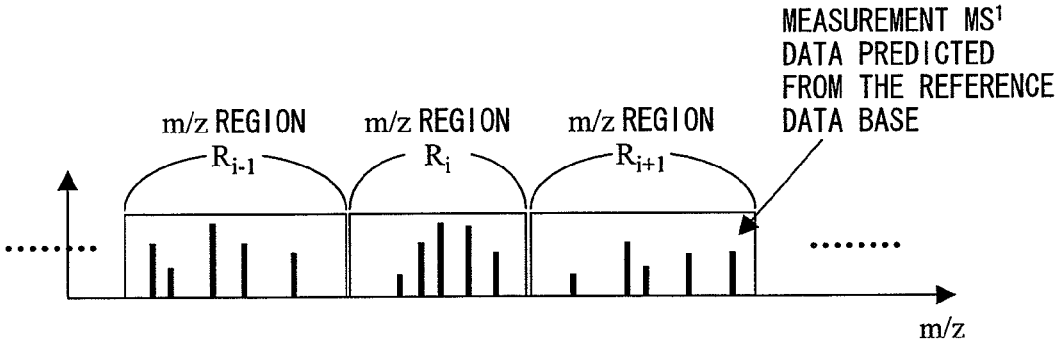

With reference to FIG. 17, the process for setting up a plurality of m/z regions in the step S11 will be explained. In the embodiment of FIG. 17A, by equally dividing the entire region of the mass charge ratio (m/z) capable of being processed by the mass analysis by the tandem type mass analysis system, the m/z regions are set up. Therefore, the all m/z regions are equal in size. In the embodiment of FIG. 17B, by dividing the entire region of the mass charge ratio (m/z) capable of being processed by the mass analysis by the tandem type mass analysis system so as to have the peaks included in each measurement $MS^1$ data allotted substantially evenly, the m/z regions are set up. In the embodiments of FIG. 17A and FIG. 17B, in the case an ion is present on the boundary of the divided regions, detection of the ion may be difficult.

Figure 17C:
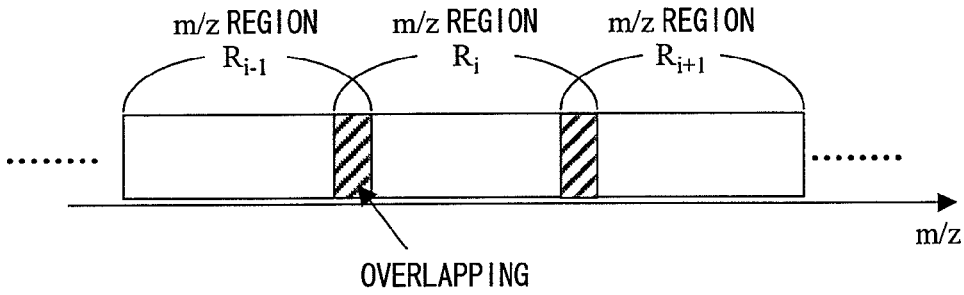

In the embodiment of FIG. 17C, a region overlapping with the adjacent m/z region is provided on the both sides of each m/z region. By providing the overlapping portion, even when an ion is present on the boundary, it can be detected.

With reference to FIG. 18, an embodiment of the user interface in the user input unit 8 of the present invention will be explained. In the embodiment shown in FIG. 18A, the tandem type mass analysis system of the present invention is referred to as the "differential component real time extraction analysis by the multi precursor $MS^2$", and an interface for selecting whether or not it is utilized is provided.

In the embodiment shown in FIG. 18B, an interface for selecting the reference data base 10 is shown. In the embodiment shown in FIG. 18C, an interface for designating the number of the m/z regions and their setting up method, and the number of stages of the tandem type mass analysis is shown.

Next, the method for utilizing the tandem type mass analysis system of the present invention will be explained. In the blood or urine of a diseased patient, compared with a healthy person, a unique protein can be observed in many cases. Such a protein is referred to as a biomarker. The biomarker may be a protein not detected for a healthy person, a protein detected also for a healthy person but with its expression amount being different from that of a protein detected for a healthy person, or the like. In the case a peptide derived from a protein with the possibility of being the biomarker is detected, the protein needs to be identified highly accurately for having the quantitative analysis.

The tandem type mass analysis system of the present invention can be used for the search of the biomarker. In this embodiment, the specimen as the analysis subject can be a living specimen such as blood and urine of a diseased patient. In the case of having such a protein as the analysis subject, one decomposed to be a peptide with a sequence of about 10 pieces of amino acids by a digestive enzyme such as a trypsin is used as the specimen. In the reference data base 10, the tandem mass analysis data with respect to a protein in a living specimen of a healthy person are stored.

In the living specimen, an extremely large number of proteins are present, but most of them are detected for both the healthy person specimen and the diseased patient specimen so that the difference thereof, that is, a protein as the differential component is merely a small portion thereof. Moreover, the protein as the differential component is included by only a minute amount in many cases.

According to the tandem type mass analysis system of the present invention, first, mass analysis is carried out for the all ions in the region for each m/z region for obtaining the measurement $MS^2$ data. The measurement $MS^2$ data are compared with the reference $MS^2$ data of the healthy person stored in the reference data base 10. In the case there is a differential component, the tandem type mass analysis is carried out for the region.

Therefore, according to this embodiment, the time needed for the differential analysis can be shortened dramatically. Or the time allotted for the differential component analysis can be increased. Therefore, even where the differential component is included by a minute amount, by increasing the number of integrations, the sensitivity can be improved for facilitating the detection.

Another embodiment of utilizing the tandem type mass analysis system of the present invention will be explained. In the embodiment described above, in the reference data base 10, the tandem mass analysis data with respect to a protein in a living specimen of a healthy person are stored. However, in this embodiment, the tandem mass analysis data for the biomarker already discovered are stored in the reference data base 10. The specimen as the analysis subject is a living specimen such as blood and urine of a diseased patient.

Even in the case of a living specimen of a diseased patient, most of the proteins included therein are same as the proteins included in a living specimen of a healthy person. Therefore, most of the proteins in a living specimen do not coincide with the biomarker.

Comparing the measurement $MS^2$ data obtained for each m/z region with the reference $MS^2$ data of the biomarker stored in the reference data base 10, most of them do not coincide. Then, in the case they are coincident, the tandem type mass analysis is carried out for the region.

Therefore, according to this embodiment, the time needed for the differential analysis can be shortened dramatically. Or the time allotted for the differential component analysis can be increased. Therefore, even where the differential component is included by a minute amount, by increasing the number of integrations, the sensitivity can be improved for facilitating the detection.

As heretofore explained, according to the present invention, in the case the component to be extracted is present only by a slight amount in the specimen, or the like, the differential component with reference to the data to be referred can be extracted at a high speed, and moreover, since tandem mass analysis is carried out in detail only in the case a differential component is detected, the differential component can be identified at a high speed and a high accuracy.

The embodiments of the present invention have been explained so far, but the present invention is not limited to the embodiments mentioned above, and it can be easily understood by those in the art that various modification can be enabled in a scope of the invention disclosed in the claims.

What is claimed is:

1. A tandem type mass analysis system having a reference data base for storing data based on mass analysis spectra of a reference specimen, a chromatography unit for separating the substances included in the specimen, an ionizing unit for ionizing the substances included in the specimen, an ion dissociating unit for dissociating the ions, an ion separating unit for separating the dissociated ions, an ion detecting unit for producing mass analysis spectra by detecting the separated ions for each mass charge ratio m/z, and a data processing unit for comparing the mass analysis spectra obtained by the ion detecting unit with the mass analysis spectra stored in the reference data base, wherein mass analysis is carried out with the all ion species included in the specimen in each mass charge ratio m/z region being dissociated for each of a plurality of preliminarily set up mass charge ratio m/z regions, the measurement $MS^2$ data as the mass analysis spectra obtained thereby are compared with the reference $MS^2$ data as the mass analysis spectra of a corresponding reference specimen stored in the reference data base, in the case there is a difference therebetween, mass analysis $MS^1$ is carried out without dissociating the all ions included in the measurement $MS^2$ data with the difference for presuming an ion to be the cause of the difference therebetween, and the measurement $MS^1$ data as the mass analysis spectra obtained thereby are compared with the reference $MS^1$ data as the mass analysis spectra of a corresponding reference specimen stored in the reference data base.

2. The tandem type mass analysis system according to claim 1, wherein in the case there is a difference therebetween in the comparison between the measurement $MS^1$ data and the reference $MS^1$ data, a predetermined ion is selected as the parent ion out of the measurement $MS^1$ data for carrying out the mass analysis with the parent ion being dissociated, and the measurement $MS^2$ data as the mass analysis spectra obtained thereby are compared with the reference $MS^2$ data as the mass analysis spectra of a corresponding reference specimen stored in the reference data base.

3. The tandem type mass analysis system according to claim 1, wherein in the case it is judged that there is an ion included in the measurement $MS^2$ data but not included in the reference $MS^2$ data in the comparison between the measurement $MS^2$ data and the reference $MS^2$ data, and that there is an ion included in the measurement $MS^1$ data but not included in the reference $MS^1$ data in the comparison between the measurement $MS^1$ data and the reference $MS^1$ data, the ion included in only the measurement $MS^1$ data is selected as the parent ion for carrying out mass analysis with the parent ion being dissociated, and the measurement $MS^2$ data as the mass analysis spectra obtained thereby are compared with the reference $MS^2$ data as the mass analysis spectra of a corresponding reference specimen stored in the reference data base.

4. The tandem type mass analysis system according to claim 1, wherein in the case it is judged that there is an ion included in the reference $MS^2$ data but not included in the measurement $MS^2$ data in the comparison between the measurement $MS^2$ data and the reference $MS^2$ data, and that there is an ion included in the reference $MS^1$ data but not included in the measurement $MS^1$ data in the comparison between the measurement $MS^1$ data and the reference $MS^1$ data, the ion included only in the reference $MS^1$ data is stored as a lacked ion in the measurement $MS^1$ data in the reference data base.

5. The tandem type mass analysis system according to claim 4, wherein in the case it is judged that there is an ion included in the reference $MS^1$ data but not included in the measurement $MS^1$ data in the comparison between the measurement $MS^1$ data and the reference $MS^1$ data, a predetermined ion out of the ion included in only the measurement $MS^1$ data is selected as the parent ion for carrying out mass analysis with the parent ion being dissociated, and the measurement $MS^2$ data as the mass analysis spectra obtained thereby are compared with the reference $MS^2$ data as the mass analysis spectra of a corresponding reference specimen stored in the reference data base.

6. The tandem type mass analysis system according to claim 1, wherein in the case there is not a difference therebetween in the comparison between the measurement $MS^1$ data and the reference $MS^1$ data, a predetermined ion out of the ion included in only the measurement $MS^1$ data is selected as the parent ion for carrying out mass analysis with the parent ion being dissociated, and the measurement $MS^2$ data as the mass analysis spectra obtained thereby are compared with the reference $MS^2$ data as the mass analysis spectra of a corresponding reference specimen stored in the reference data base.

7. The tandem type mass analysis system according to claim 1, wherein in the case there is an ion having a different mass charge ratio m/z between the ions included in the measurement $MS^2$ data and the ions included in the reference $MS^2$ data or in the case there is an ion having a different ion detection intensity although with the same mass charge ratio m/z in the comparison of the measurement $MS^2$ data and the reference $MS^2$ data, it is judged that they are different.

8. The tandem type mass analysis system according to claim 1, wherein in the case there is an ion having a different mass charge ration m/z between the ions included in the measurement $MS^1$ data and the ions included in the reference $MS^1$ data or in the case there is an ion having a different ion detection intensity although with the same mass charge ratio m/z in the comparison of the measurement $MS^1$ data and the reference $MS^1$ data, it is judged that they are different.

9. The tandem type mass analysis system according to claim 1, wherein the reference data base stores the reference $MS^1$ data as the mass analysis spectra obtained by carrying out the mass analysis without dissociation for the all ions included in each mass charge ratio m/z region for each ion species of the mass charge ratio m/z, and the reference $MS^2$ data as the mass analysis spectra obtained by carrying out the mass analysis with the all ions included in the reference $MS^1$ data being dissociated collectively, corresponding with each other.

10. The tandem type mass analysis system according to claim 1, wherein the reference data base stores the reference $MS^1$ data as the mass analysis spectra obtained by carrying out the mass analysis without dissociation for the all ions included in each mass charge ratio m/z region for each ion species of the mass charge ratio m/z, and the reference $MS^2$ data as the mass analysis spectra obtained by carrying out the mass analysis with each of the ions included in the reference $MS^1$ data being dissociated, corresponding with each other.

11. A tandem mass analysis method comprising:

a reference data base producing step of storing preliminarily measured mass analysis spectra of a reference specimen in a reference data base as reference data, a region setting up step of setting up a predetermined number of mass charge ratio m/z regions, a preliminary measurement $MS^2$ data measuring step of obtaining preliminary measurement $MS^2$ data as the mass analysis spectra by carrying out the mass analysis with the all ions in the specimen included in each mass charge ratio m/z region being dissociated collectively for each of the mass charge ratio m/z regions, a differential detecting step for the preliminary measurement $MS^2$ data of detecting a difference therebetween by comparing each of the preliminary measurement $MS^2$ data with the corresponding preliminary reference $MS^2$ data stored in the reference data base, a first stage measurement $MS^1$ data measuring step of obtaining first stage measurement $MS^1$ data as the mass analysis spectra by carrying out the mass analysis without dissociation for the all ions included in the preliminary measurement $MS^2$ data with the difference detected collectively, a differential detecting step for the first stage measurement $MS^1$ data of detecting a difference therebetween by comparing the first stage measurement $MS^1$ data with the corresponding first stage reference $MS^1$ data stored in the reference data base, a parent ion presuming step of presuming the ion as the cause of the difference between the preliminary measurement $MS^2$ data and the preliminary reference $MS^2$ data out of the first stage measurement $MS^1$ data, a second stage measurement $MS^2$ data measuring step of obtaining second stage measurement $MS^2$ data as the mass analysis spectra by carrying out the mass analysis with the presumed parent ion being dissociated, and a differential detecting step for the second stage measurement $MS^2$ data of detecting a difference therebetween by comparing the second stage measurement $MS^2$ data with the corresponding second stage reference $MS^2$ data stored in the reference data base.

12. The tandem type mass analysis method according to claim 11, wherein in the case it is judged that there is an ion included in the preliminary measurement $MS^2$ data but not included in the preliminary reference $MS^2$ data in the differential detecting step for the second stage measurement $MS^2$ data, and that there is an ion included in the first stage measurement $MS^1$ data but not included in the first stage reference $MS^1$ data in the differential detecting step for the first stage reference $MS^1$ data, the ion included in only the first stage measurement $MS^1$ data is selected as the parent ion in the parent ion presuming step.

13. The tandem type mass analysis method according to claim 11, wherein in the case it is judged that there is an ion included in the preliminary reference $MS^2$ data but not included in the preliminary measurement $MS^2$ data in the differential detecting step for the second stage measurement $MS^2$ data, and that there is an ion included in the first stage reference $MS^1$ data but not included in the first stage measurement $MS^1$ data in the differential detecting step for the first stage reference $MS^1$ data, the ion included in only the first stage reference $MS^1$ data is stored in the reference data base as a lacked ion of the first stage measurement $MS^1$ data.

14. The tandem type mass analysis method according to claim 11, wherein in the case it is judged that there is an ion included in the preliminary reference $MS^2$ data but not included in the preliminary measurement $MS^2$ data in the differential detecting step for the second stage measurement $MS^2$ data, and that there is an ion included in the first stage reference $MS^1$ data but not included in the first stage measurement $MS^1$ data in the differential detecting step for the first stage reference $MS^1$ data, a predetermined ion out of the ion included in the first stage measurement $MS^1$ data is presumed as the parent ion in the parent ion presuming step.

15. The tandem type mass analysis method according to claim 11, wherein in the case it is judged that there is not a difference therebetween in the differential detecting step for first stage measurement $MS^1$ data, a predetermined ion out of the ion included in the measurement $MS^1$ data is presumed as the parent ion in the parent ion presuming step.

16. The tandem type mass analysis method according to claim 11, wherein in the differential detecting step for the preliminary measurement $MS^2$ data, in the case there is an ion having a different mass charge ratio m/z between the ions included in the preliminary measurement $MS^2$ data and the ions included in the preliminary reference $MS^2$ data, and in the case there is an ion having a different ion detection intensity although with the same mass charge ratio m/z, they are judged to be different.

17. The tandem type mass analysis method according to claim 11, wherein in the differential detecting step for first stage measurement $MS^1$ data, in the case there is an ion having a different mass charge ratio m/z between the ions included in the first stage measurement $MS^1$ data and the ions included in the first stage reference $MS^1$ data, and in the case there is an ion having a different ion detection intensity although with the same mass charge ratio m/z, they are judged to be different.

18. A health diagnosis system having a reference data base with mass analysis spectra of a standard specimen stored, and having a tandem type mass analysis apparatus for carrying out a tandem type mass analysis for a sample specimen of an examinee, wherein mass analysis is carried out with the all ions in the sample specimen of the examinee included in each mass charge ratio m/z region being dissociated for each of a plurality of preliminarily set up mass charge ratio m/z regions, the measurement $MS^2$ data as the mass analysis spectra obtained thereby are compared with the reference $MS^2$ data as the mass analysis spectra of a corresponding standard specimen stored in the reference data base, in the case there is a difference therebetween, mass analysis is carried out without dissociating the all ions included in the mass charge ratio m/z region with the difference for presuming an ion to be the cause of the difference therebetween, and the measurement $MS^1$ data as the mass analysis spectra obtained thereby are compared with the reference $MS^1$ data as the mass analysis spectra of a corresponding standard specimen stored in the reference data base.

19. The health diagnosis system according to claim 18, wherein mass analysis spectra of a sample specimen of a healthy person are stored in the reference data base.

20. The health diagnosis system according to claim 18, wherein mass analysis spectra of a biomarker are stored in the reference data base.

* * * * *